US008004484B2

(12) United States Patent
Tateuchi et al.

(10) Patent No.: US 8,004,484 B2
(45) Date of Patent: Aug. 23, 2011

(54) DISPLAY DEVICE, LIGHT RECEIVING METHOD, AND INFORMATION PROCESSING DEVICE

(75) Inventors: Mitsuru Tateuchi, Kanagawa (JP); Go Yamanaka, Kanagawa (JP); Tsutomu Harada, Kanagawa (JP); Takeru Tamayama, Kanagawa (JP); Masafumi Matsui, Kanagawa (JP)

(73) Assignee: Sony Corporation, Tokyo (JP)

( * ) Notice: Subject to any disclaimer, the term of this patent is extended or adjusted under 35 U.S.C. 154(b) by 757 days.

(21) Appl. No.: 11/857,280

(22) Filed: Sep. 18, 2007

(65) Prior Publication Data

US 2008/0084377 A1 Apr. 10, 2008

(51) Int. Cl.
*G09G 3/36* (2006.01)

(52) U.S. Cl. ..... 345/92

(58) Field of Classification Search ..... 345/173, 345/175, 87, 90, 92, 102
See application file for complete search history.

(56) References Cited

U.S. PATENT DOCUMENTS

| | | | | |
|---|---|---|---|---|
| 7,184,009 | B2 | 2/2007 | Bergquist | |
| 7,190,336 | B2 | 3/2007 | Fujisawa | |
| 7,230,608 | B2 * | 6/2007 | Cok | 345/173 |
| 2005/0219229 | A1 | 10/2005 | Yamaguchi | |
| 2005/0225521 | A1 * | 10/2005 | Leo et al. | 345/87 |
| 2005/0270260 | A1 * | 12/2005 | Pelzer et al. | 345/82 |
| 2006/0103637 | A1 | 5/2006 | Yamaguchi et al. | |
| 2006/0119590 | A1 * | 6/2006 | Park et al. | 345/175 |
| 2006/0244693 | A1 * | 11/2006 | Yamaguchi et al. | 345/76 |
| 2006/0256093 | A1 * | 11/2006 | Furukawa et al. | 345/173 |

FOREIGN PATENT DOCUMENTS

| | | |
|---|---|---|
| JP | 2000-010123 | 1/2000 |
| JP | 2000-19478 | 1/2000 |
| JP | 2004-127272 | 4/2004 |
| JP | 2005-031661 | 2/2005 |
| JP | 2005-284661 | 10/2005 |
| JP | 2005-293374 | 10/2005 |
| JP | 2005-530217 | 10/2005 |
| JP | 2005-327106 | 11/2005 |
| JP | 2006-013407 | 1/2006 |
| JP | 2006-127212 | 5/2006 |
| JP | 2006-244218 | 9/2006 |
| JP | 2006-244446 | 9/2006 |
| WO | 2005/091262 | 9/2005 |
| WO | 2006/117955 | 11/2006 |

* cited by examiner

*Primary Examiner* — Richard Hjerpe
*Assistant Examiner* — Jeffrey Parker
(74) *Attorney, Agent, or Firm* — K&L Gates LLP

(57) ABSTRACT

A display device, light receiving method, and information processing device are provided. The display device including a plurality of sub-pixels forming a pixel as a unit of display resolution of an image, the plurality of sub-pixels being arranged in a delta arrangement, a display circuit for displaying the image, a light receiving sensor for detecting light, the display circuit and the light receiving sensor being disposed in each of the sub-pixels, wherein display signal lines for supplying a display signal to the sub-pixels are wired to all of the sub-pixels in a same direction, two or more the light receiving sensors arranged in a direction perpendicular to the wiring direction of the display signal lines are connected to each other, and a received light signal obtained from the two or more the light receiving sensors connected to each other is output from a light receiving circuit.

21 Claims, 15 Drawing Sheets

DISPLAY DEVICE, LIGHT RECEIVING METHOD, AND INFORMATION PROCESSING DEVICE

CROSS REFERENCES TO RELATED APPLICATIONS

The present application claims priority to Japanese Patent Application JP 2006-27604 filed in the Japan Patent Office on Oct. 10, 2006, the entire contents of which being incorporated herein by reference.

BACKGROUND

The present application relates to a display device, a light receiving method, and an information processing device, and particularly to a display device, a light receiving method, and an information processing device that can improve the S/N ratio of a received light signal with a simple configuration.

A display device that has a display circuit and a light receiving circuit arranged on a same substrate and is thus able to display an image and receive external light has been proposed (see for example, Japanese Patent Laid-Open No. 2000-19478 and Japanese Patent Laid-Open No. 2006-127212). The light receiving circuit in the display device detects for example light emitted from an object (for example a pen or the like) having an external light source such as an LED (Light Emitting Diode) or the like or light as a result of light from a backlight being reflected and returned by a finger or a pen in contact with a screen. In Japanese Patent Laid-Open No. 2006-127212, the present applicant proposes a method of driving a light receiving circuit when detecting light as a result of light from a backlight being reflected and returned by a finger or a pen in contact with a screen.

While Japanese Patent Laid-Open No. 2000-19478 and Japanese Patent Laid-Open No. 2006-127212 disclose techniques for a liquid crystal display device of a type that controls liquid crystal by the display circuit, there is also a display device that performs image display and light reception using an organic EL (electroluminescence) element as a self-luminous element (see for example, Japanese Patent Laid-Open No. 2004-127272 and Japanese Patent Laid-Open No. 2005-293374).

In a display device having a display circuit and a light receiving circuit arranged on a same substrate as described above, when the S/N ratio of a received light signal output by the light receiving circuit is to be increased, the sensor size of a light receiving sensor needs to be enlarged. However, it is difficult to simply enlarge the sensor size of the light receiving sensor because of physical limitations for maintaining display performance such as securing an aperture.

SUMMARY

The present application has been made in view of such a situation, and it is desirable to improve the S/N ratio of the received light signal with a simple configuration.

According to an embodiment, there is provided a display device including a plurality of sub-pixels forming a pixel as a unit of display resolution of an image, the plurality of sub-pixels being arranged in a delta arrangement, a display circuit for displaying the image, a light receiving sensor for detecting light, the display circuit and the light receiving sensor being disposed in each of the sub-pixels, wherein display signal lines for supplying a display signal to the sub-pixels are wired to all of the sub-pixels in a same direction, two or more the light receiving sensors arranged in a direction perpendicular to the wiring direction of the display signal lines are connected to each other, and a received light signal obtained from the two or more the light receiving sensors connected to each other is output from a light receiving circuit.

According to an embodiment, there is provided a light receiving method of a display device, the display device having a plurality of sub-pixels forming a pixel as a unit of display resolution of an image, the plurality of sub-pixels being arranged in a delta arrangement, a display circuit for displaying the image and a light receiving sensor for detecting light, the display circuit and the light receiving sensor being disposed in each of the sub-pixels, and display signal lines for supplying a display signal to the sub-pixels, the display signal lines being wired to all of the sub-pixels in a same direction, the light receiving method including: outputting a received light signal obtained from two or more light receiving sensors arranged in a direction perpendicular to the wiring direction of the display signal lines.

According to an embodiment, there is provided an information processing device including: displaying and light receiving means for displaying predetermined information as an image and detecting light by a light receiving sensor; input information analyzing means for analyzing externally input information such as information input by a user, using a received light image generated from a received light signal output by the light receiving sensor; and controlling means for performing a predetermined controlling process in correspondence with a message supplied from the input information analyzing means; wherein in the displaying and light receiving means, a plurality of sub-pixels forming a pixel as a unit of display resolution of the image are arranged in a delta arrangement, a display circuit for displaying the image and the light receiving sensor are disposed in each of the sub-pixels, and a display signal line for supplying a display signal to the sub-pixels is wired to all of the sub-pixels in a same direction, and the displaying and light receiving means outputs a received light signal obtained from two or more light receiving sensors arranged in a direction perpendicular to the wiring direction of the display signal lines.

The subject matter of the present application can improve the S/N ratio of the received light signal with the simple configuration according to the embodiment.

Additional features and advantages are described herein, and will be apparent from, the following Detailed Description and the figures.

DETAILED DESCRIPTION

Preferred embodiments will hereinafter be described.

Figure 12:
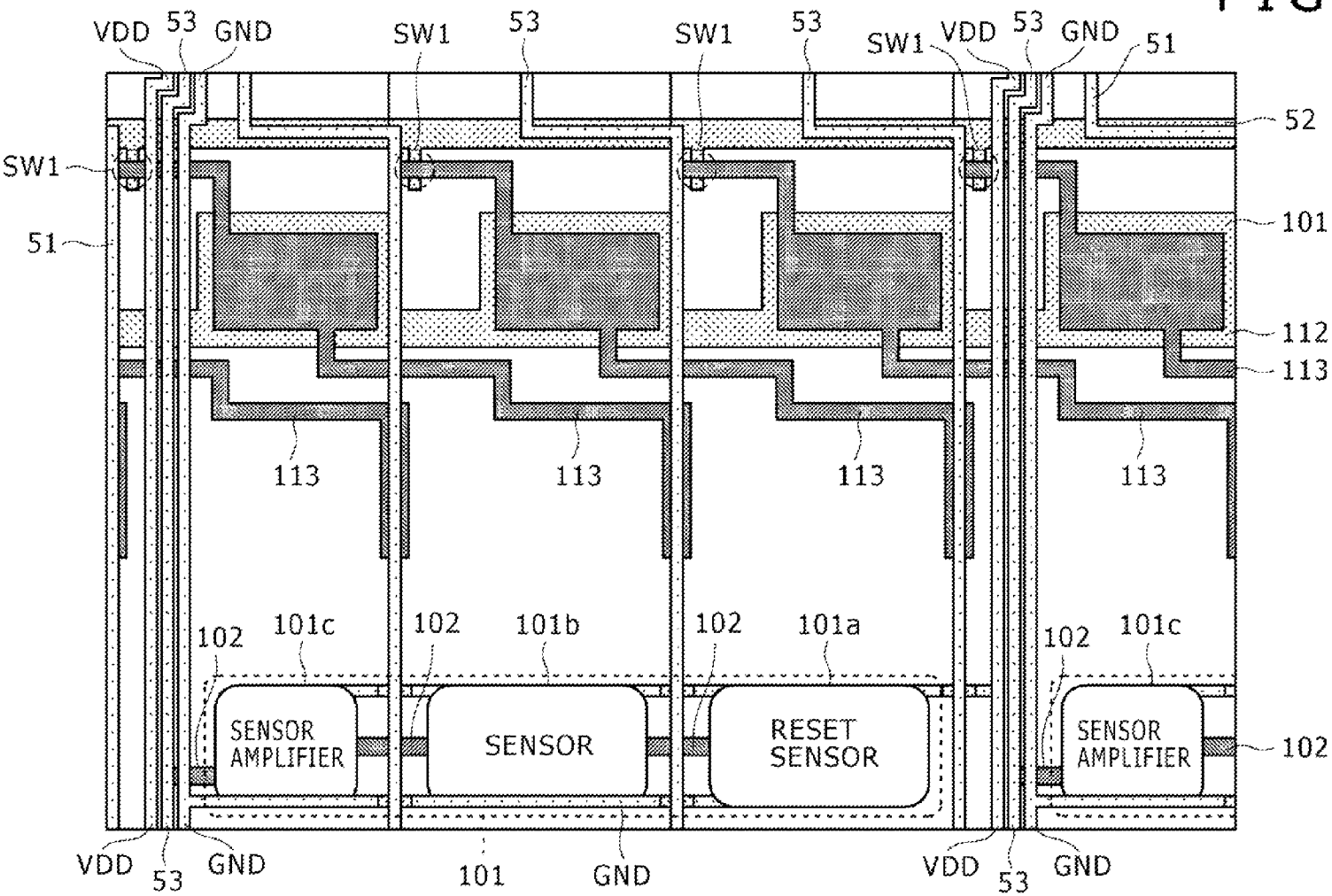
FIG. 12 is a diagram showing an example of an arrangement of a light receiving circuit in the display panel in FIG. 1.

A display device according to an embodiment is a display device (for example a display panel 25 in FIG. 1) having a plurality of sub-pixels forming a pixel as a unit of display resolution of an image, the plurality of sub-pixels being arranged in a delta arrangement, and a display circuit (for example a display circuit 41 in FIG. 4) for displaying the image and a light receiving sensor (for example a sensor SSR in FIG. 7) for detecting light, the display circuit and the light receiving sensor being disposed in each of the sub-pixels (for example sub-pixels SubPix in FIG. 7), wherein display signal lines (for example display signal lines 51 in FIG. 12) for supplying a display signal to the sub-pixels are wired to all of the sub-pixels in a same direction; and two or more light receiving sensors (for example subordinate light receiving circuits 101*a* to 101*c* in FIG. 12) arranged in a direction perpendicular to the wiring direction of the display signal lines are connected to each other, whereby a light receiving circuit (for example a light receiving circuit 101 in FIG. 12) for outputting a received light signal obtained from the two or more light receiving sensors connected to each other is provided.

An information processing device according to an embodiment includes: displaying and light receiving means (for example a display panel 25 in FIG. 1) for displaying predetermined information as an image and detecting light by a light receiving sensor; input information analyzing means (for example an input information analyzing unit 27 in FIG. 1) for analyzing externally input information such as information input by a user, using a received light image generated from a received light signal output by the light receiving sensor; and controlling means (for example a controlling unit 11 in FIG. 1) for performing a predetermined controlling process in correspondence with a message supplied from the input information analyzing means; wherein in the displaying and light receiving means, a plurality of sub-pixels forming a pixel as a unit of display resolution of an image are arranged in a delta arrangement, a display circuit for displaying the image and the light receiving sensor are disposed in each of the sub-pixels, and a display signal line for supplying a display signal to the sub-pixels is wired to all of the sub-pixels in a same direction, and the displaying and light receiving means outputs a received light signal obtained from two or more light receiving sensors arranged in a direction perpendicular to the wiring direction of the display signal lines.

Preferred embodiments of the present application will hereinafter be described with reference to the drawings.

Figure 1:
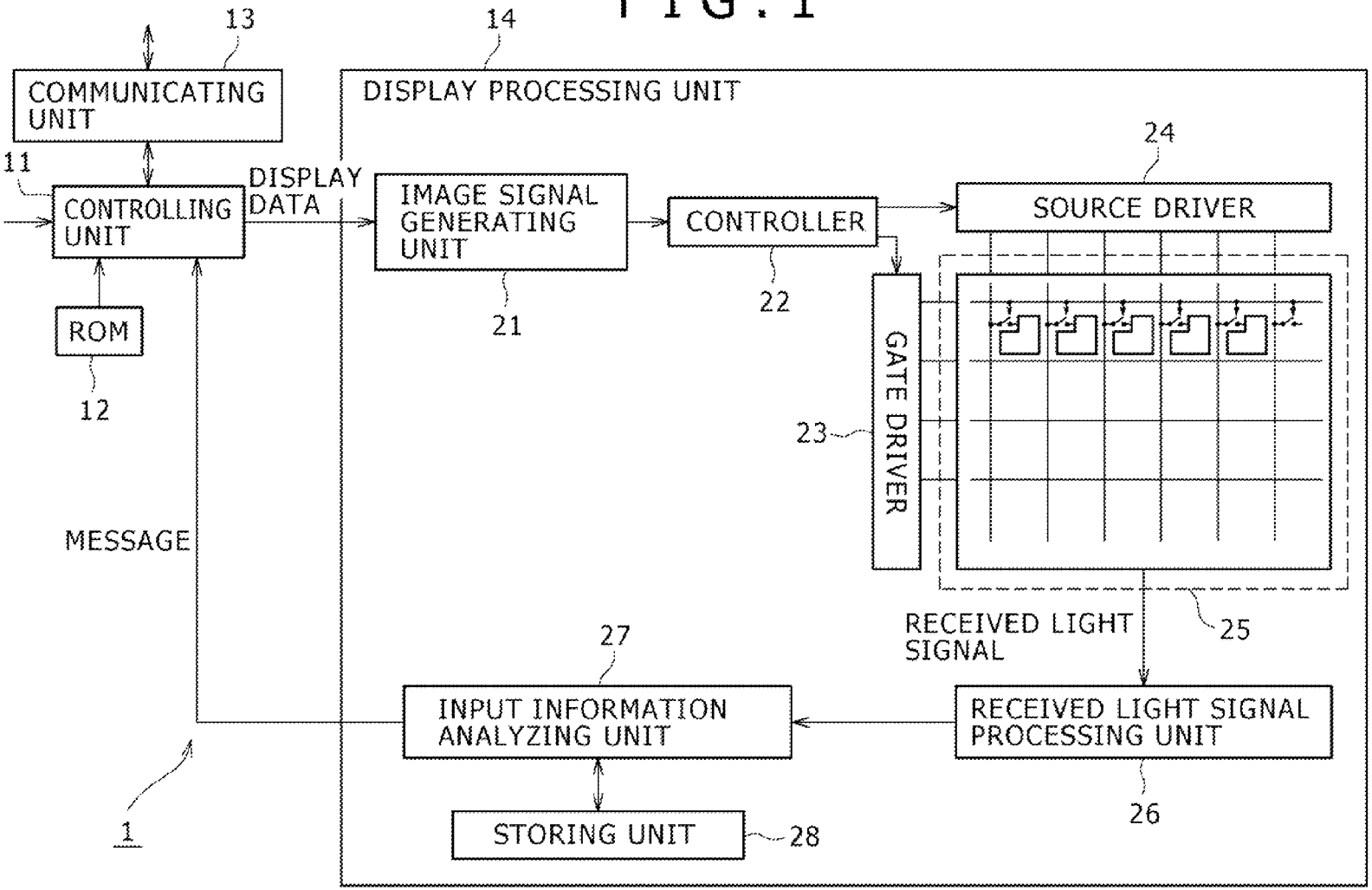
FIG. 1 is a diagram showing an example of configuration of an embodiment of an information processing device.

FIG. 1 shows an example of configuration of an embodiment of an information processing device to which the present application is applied.

An information processing device 1 of FIG. 1 is a portable telephone, a digital still camera, a PDA (Personal Digital Assistant) or the like that has at least a display device displaying predetermined information as an image and performs predetermined information processing such as call processing, image pickup processing, data transmission and reception processing, and the like. The information processing device 1 allows predetermined information to be input by specifying a position on a screen of the display device by a finger, a pen or the like.

The information processing device 1 includes a controlling unit 11, a ROM 12, a communicating unit 13, a display processing unit 14, and the like. The display processing unit 14 corresponds to the above-described display device. The display processing unit 14 includes an image signal generating unit 21, a controller 22, a gate driver 23, a source driver 24, a display panel 25, a received light signal processing unit 26, an input information analyzing unit 27, and a storing unit 28.

The controlling unit 11 controls the operation of the whole of the information processing device 1 on the basis of a controlling program stored in the ROM (Read Only Memory) 12. For example, the controlling unit 11 supplies display data to be displayed on the display panel 25 to the image signal generating unit 21 on the basis of a command from another module not shown in the figure or data received by the communicating unit 13. In addition, as will be described later, the controlling unit 11 updates the display data supplied to the image signal generating unit 21 or supplies data to the communicating unit 13 or another module in response to a message supplied from the input information analyzing unit 27.

Another module in this case is for example a module performing a call function when the information processing device 1 is a portable telephone, or a module performing an image pickup function when the information processing device 1 is a digital still camera. The communicating unit 13 communicates with various devices via a network such as the Internet or the like by wire or by radio, and supplies obtained data to the controlling unit 11. Incidentally, when the information processing device 1 does not need to communicate with the outside, the communicating unit 13 can be omitted.

The image signal generating unit 21 generates an image signal for displaying an image corresponding to the display data supplied from the controlling unit 11. The image signal generating unit 21 outputs the generated image signal to the controller 22, which controls the driving of the display panel 25.

The controller 22 controls the driving of the gate driver 23, which controls the turning on (conduction) or off (non-conduction) of a switching element disposed in each pixel of the display panel 25, and the driving of the source driver 24, which supplies a voltage signal (hereinafter referred to as a display signal) corresponding to the image signal to each pixel in such a manner as to be interlocked with the driving of the gate driver 23.

The display panel 25 is for example an LCD (Liquid Crystal Display) in which m×n pixels with m pixels in a horizontal direction and n pixels in a vertical direction are arranged in the form of a matrix. The display panel 25 changes transmittance for light from a backlight not shown in the figure by a liquid crystal layer, thereby displaying predetermined information as an image. In addition, the display panel 25 includes a light receiving sensor to receive returned light resulting from the light from the backlight being reflected and returned by a finger, a pen or the like in contact with or adjacent to a surface in an uppermost part of the display panel 25. The display panel 25 supplies a received light signal obtained as a result of receiving the returned light to the received light signal processing unit 26. Thus, the display panel 25 includes a display circuit for displaying an image and a light receiving circuit for detecting light as input information.

Incidentally, one pixel as a unit of display resolution (image display unit) is formed by three pixels of R (Red), G (Green), and B (Blue). Therefore, to be exact, the number of all pixels forming the display panel 25 is 3 m×n. Hereinafter, a pixel as a unit of display resolution formed by three pixels of R, G, and B will be referred to as a pixel, and each of pixels of R, G, and B forming a pixel will be referred to as a sub-pixel.

An arrangement of the pixels of the display device is typified by a stripe arrangement and a delta arrangement. In the display panel 25, the pixels are arranged in the delta arrangement.

Figure 2:
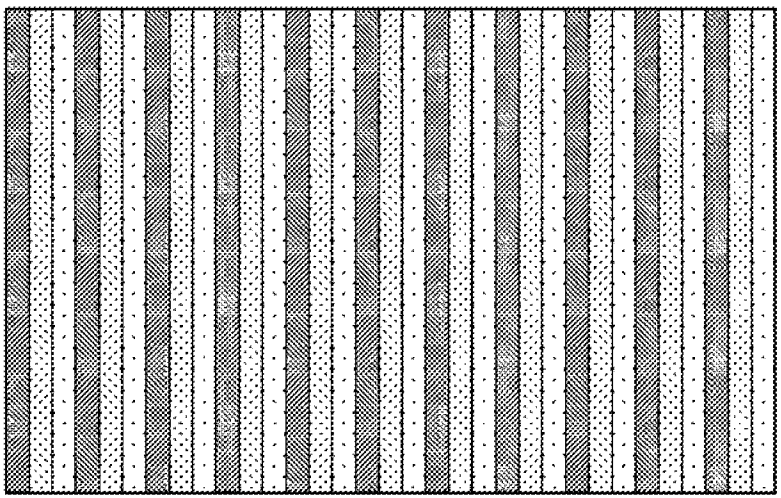
FIG. 2 is a diagram of assistance in explaining a stripe arrangement.
Figure 2:
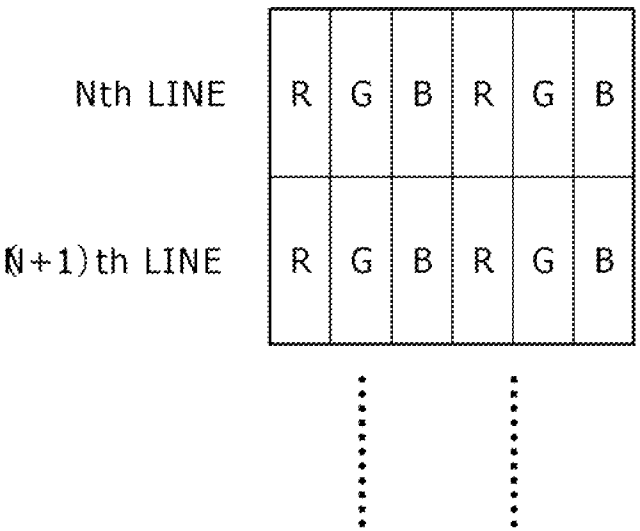
Figure 3:
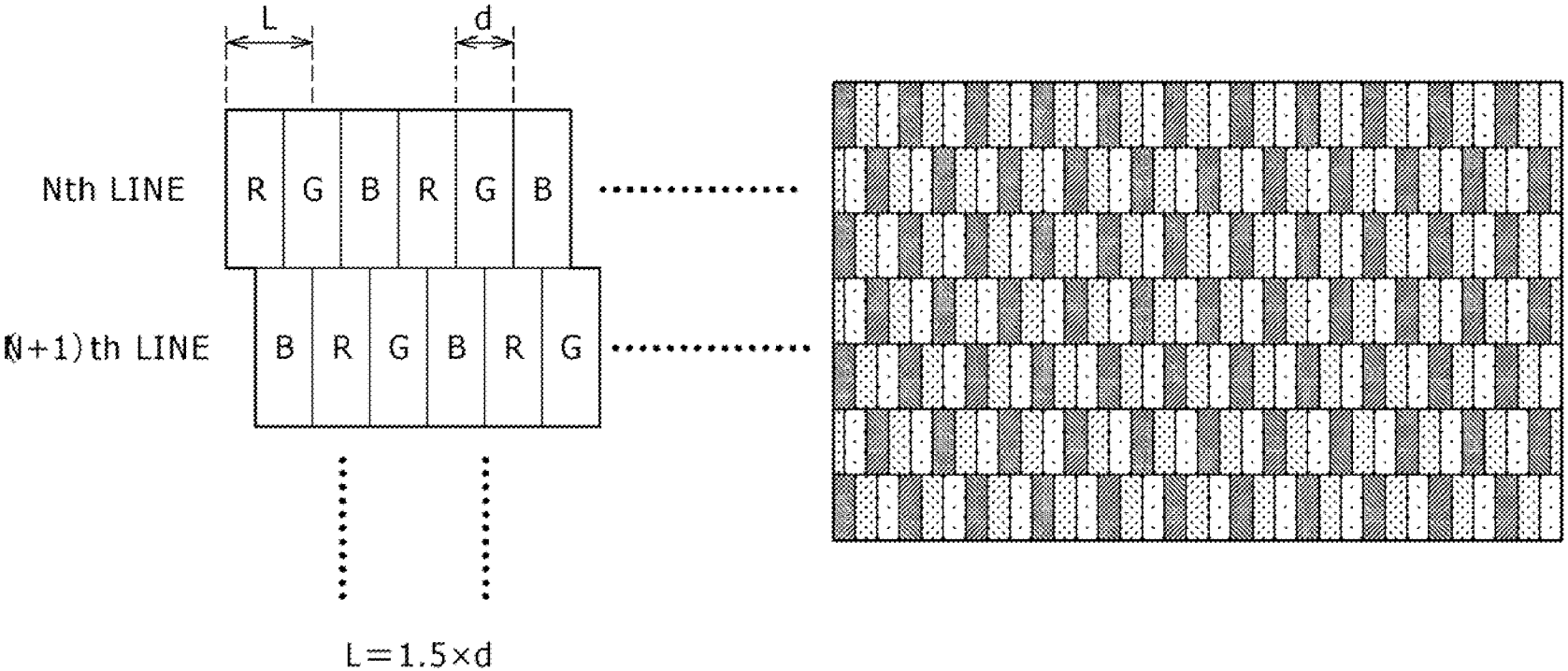
FIG. 3 is a diagram of assistance in explaining a delta arrangement.

The stripe arrangement and the delta arrangement are similar to each other in that sub-pixels of R, G, and B are arranged in order in a horizontal direction. However, the stripe arrangement and the delta arrangement are different from each other in that, as shown in FIG. 2, the positions of sub-pixels of the respective colors are the same between an Nth line and an (N+1)th line in a vertical direction in the stripe arrangement, whereas as shown in FIG. 3, the positions of sub-pixels of the respective colors are shifted from each other by a length L between the Nth line and the (N+1)th line in the vertical direction in the delta arrangement. The length L in this case is 1.5 times the width d of a sub-pixel.

The stripe arrangement is often employed by the display devices of personal computers and portable telephones that use data and text display heavily, while the delta arrangement is often employed by the display devices of camcorders, digital still cameras and the like as devices displaying natural images.

Returning to FIG. 1, the received light signal processing unit 26 subjects the received light signal supplied from the display panel 25 to predetermined amplification processing, filter processing, image processing or the like. The received light signal processing unit 26 then supplies the received light signal shaped after the processing to the input information analyzing unit 27.

The input information analyzing unit 27 analyzes a position (contact position) on the screen which position is specified by a finger, a pen or the like, using a received light image generated from the received light signal, and thereby analyzes information input by the user. The input information analyzing unit 27 then supplies a result of the analysis as a message to the controlling unit 11. For example, when a received light signal of an Nth frame is supplied from the received light signal processing unit 26 to the input information analyzing unit 27, the input information analyzing unit 27 compares a received light image generated from the received light signal of the Nth frame with a received light image of an immediately preceding frame ((N−1)th frame) stored in the storing unit 28, and thereby calculates a difference between the two received light images. Then, on the basis of the calculated difference, the input information analyzing unit 27 analyzes the movement of the contact position from the previous frame. When there are a plurality of contact positions, the analysis is performed for each of the plurality of contact positions. Further, the input information analyzing unit 27 compares the movement of the contact position with information on change of the contact position for a predetermined past frame period which information is stored in the storing unit 28. The input information analyzing unit 27 then determines a message relating to the detection of the contact position which message is to be supplied to the controlling unit 11.

Description will next be made of a display circuit and a light receiving circuit provided in the display panel 25. However, prior to the description, an example of arrangement of a display circuit in related art and a light receiving circuit in related art within a sub-pixel is shown in FIG. 4.

Figure 4:
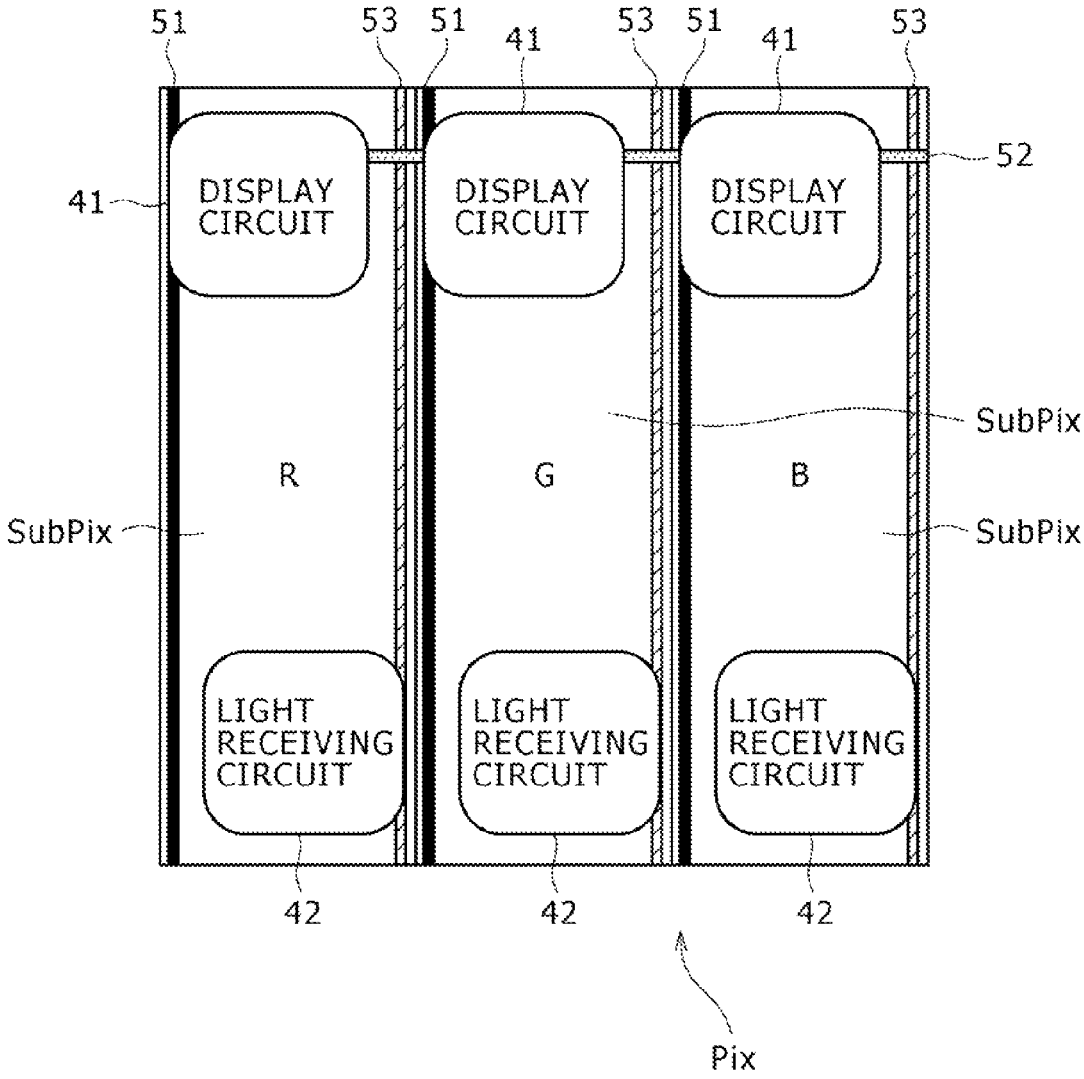
FIG. 4 is a diagram showing an example of an arrangement of display circuits and light receiving circuits in related art.

As shown in FIG. 4, a pixel Pix is formed by arranging sub-pixels SubPix of R, G, and B in a horizontal direction. A display circuit 41 is disposed on an upper side in FIG. 4 within each of the sub-pixels SubPix of R, G, and B, and a light receiving circuit 42 is disposed on a lower side in FIG. 4 within each of the sub-pixels SubPix of R, G, and B. The display circuit 41 and the light receiving circuit 42 are formed on a same substrate (glass substrate).

A display signal line 51 is connected to the display circuit 41 in each sub-pixel SubPix. A display signal is supplied from the source driver 24 via the display signal line 51. The display circuits 41 of the sub-pixels SubPix of R, G, and B are also connected to a same display selection line 52 extending in the horizontal direction. The display circuits 41 of the sub-pixels SubPix of R, G, and B are supplied with a display selection signal from the gate driver 23 via the display selection line 52. The display circuit 41 controls light from the backlight according to the display selection signal and the display signal.

Figure 5:
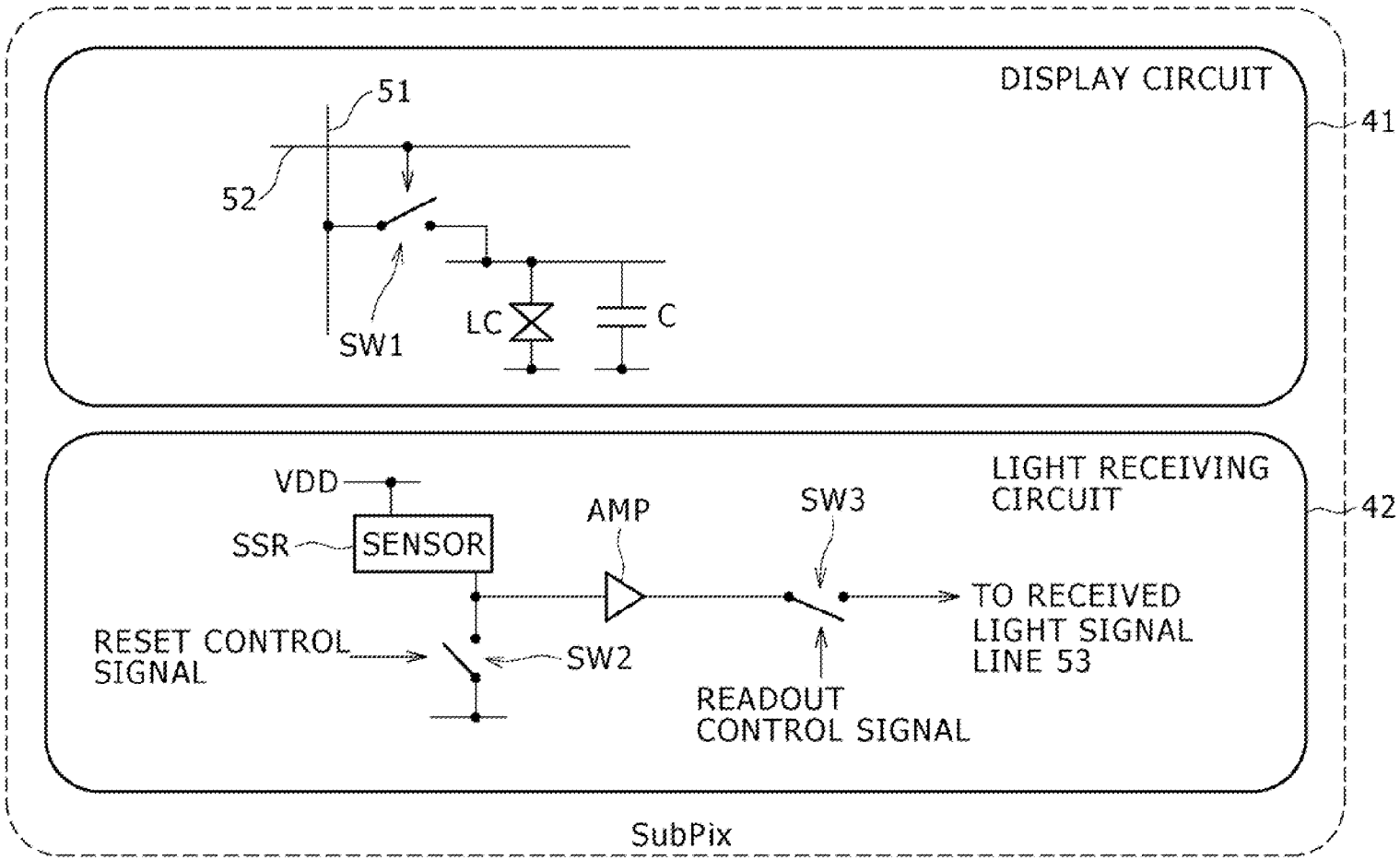
FIG. 5 is a diagram showing a circuit example of a display circuit and a light receiving circuit in a case where a display panel is formed by an LCD (Liquid Crystal Display)

On the other hand, a received light signal line 53 is connected to the light receiving circuit 42 in each sub-pixel SubPix. The light receiving circuit 42 controls light reception by a light receiving sensor SSR (FIG. 5). The light receiving circuit 42 supplies a light reception signal generated by the light reception by the light receiving sensor to the received light signal processing unit 26 via the received light signal line 53.

FIG. 5 shows a circuit example of the display circuit 41 and the light receiving circuit 42.

The display circuit 41 includes a switching element SW1, a liquid crystal layer LC, a storage capacitor C and the like. The switching element SW1 is formed by a TFT (Thin Film Transistor), for example.

In the display circuit 41, the switching element SW1 turns on or off a connection therein according to the display selection signal supplied from the gate driver 23 via the display selection line 52. When the switching element SW1 is on, a display signal from the source driver 24 is supplied to the liquid crystal layer LC and the storage capacitor C via the display signal line 51, and thus a predetermined voltage is applied to the liquid crystal layer LC and the storage capacitor C. In the liquid crystal layer LC, the alignment of liquid crystal molecules changes according to the applied voltage, and light from the backlight is emitted to a front surface side of the display panel 25. When the switching element SW1 is off, the voltage applied to the liquid crystal layer LC and the storage capacitor C is retained. With sub-pixels SubPix arranged in a row in the horizontal direction as a horizontal line, the turning on and off of the switching element SW1 is sequentially changed in a vertical direction for each horizontal line, that is, line-sequential scanning is performed, whereby an image is displayed by the display panel 25 as a whole.

The light receiving circuit 42 includes switching elements SW2 and SW3, a sensor SSR, and an amplifier AMP. Each of the switching elements SW2 and SW3 is formed by a TFT, for example. The sensor SSR is for example formed by a photodiode or a TFT.

The sensor SSR receives light incident from the surface of the display panel 25, and outputs a current signal corresponding to an amount of the received light to the amplifier AMP. The amplifier AMP converts the input current signal to a voltage signal, amplifies the voltage signal, and then outputs the result as a received light signal. The switching element SW3 turns on or off a connection therein according to a readout control signal. When the switching element SW3 is on, the output received light signal is supplied to the received light signal processing unit 26 via the received light signal line 53. The switching element SW2 turns on or off a connection therein according to a reset control signal. When the switching element SW2 is on, the received light signal is reset.

The display circuit 41 and the light receiving circuit 42 formed as described above are disposed within the sub-pixels SubPix, as shown in FIG. 4.

Incidentally, the display panel 25 can also be realized by an EL display using an organic or inorganic EL element, which is a self-luminous element, in place of an LCD.

Figure 6:
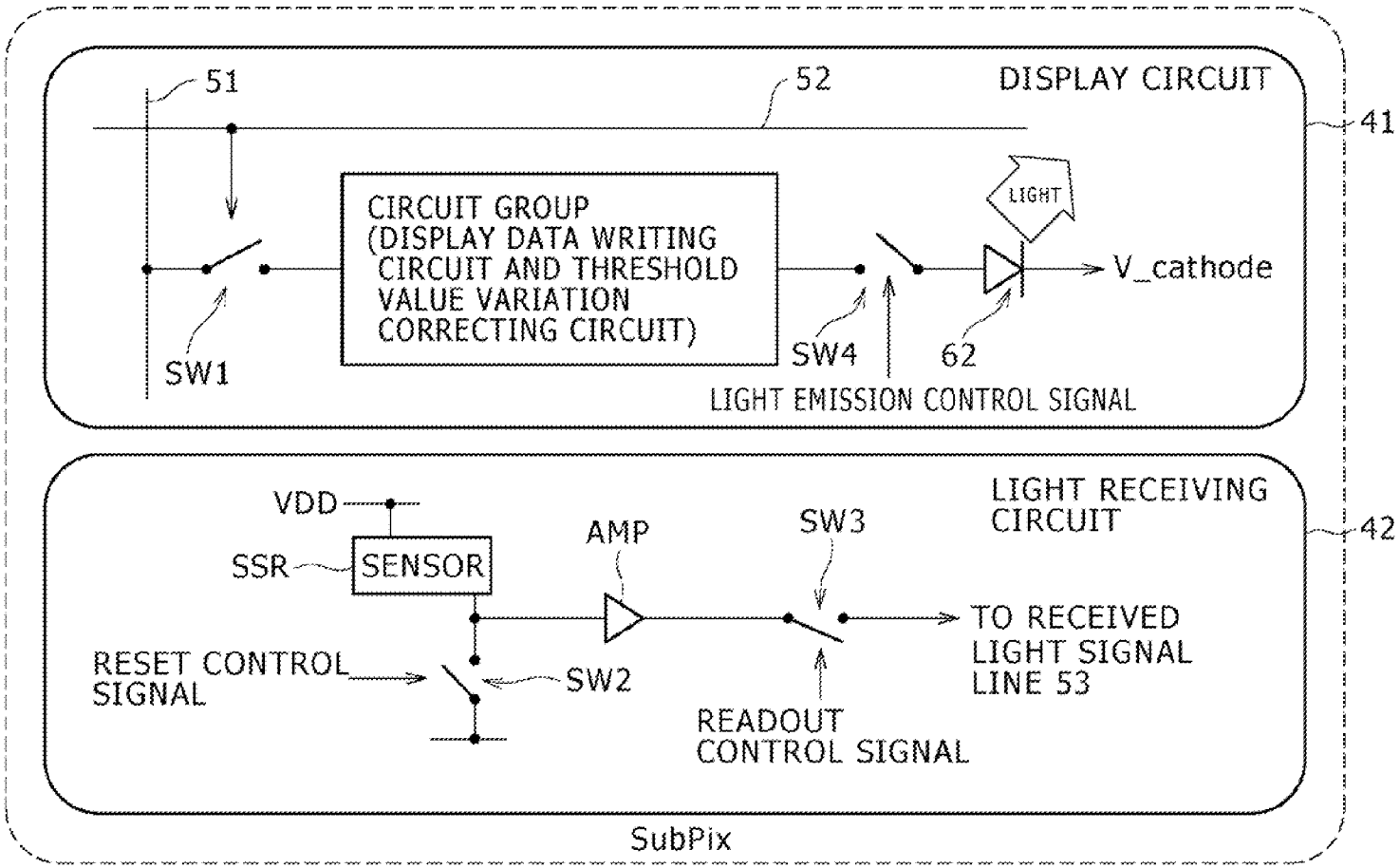
FIG. 6 is a diagram showing a circuit example of a display circuit and a light receiving circuit in a case where a display panel is formed by an EL display.

FIG. 6 shows a circuit example of a display circuit 41 in related art and a light receiving circuit 42 in related art when the display panel 25 is formed by an EL display. Incidentally, the light receiving circuit 42 is the same as in FIG. 5, and therefore description of the light receiving circuit 42 will be omitted.

The display circuit 41 includes switching elements SW1 and SW4, a circuit group 61, and an EL element 62.

The circuit group 61 includes for example a display data writing circuit and a threshold value variation correcting circuit. The display data writing circuit is an I/V (current/voltage) converter circuit for converting the display signal (voltage signal) supplied from the switching element SW1 into a current signal. The threshold value variation correcting circuit corrects variations of the display signal which variations are caused by the switching element SW1 (TFT threshold value correcting circuit).

The switching element SW1 turns on or off a connection therein according to the display selection signal supplied from the gate driver 23 via the display selection line 52. When the switching element SW1 is on, a display signal from the source driver 24 is supplied to the circuit group 61 via the display signal line 51. The circuit group 61 subjects the input display signal to processing such as the above-described I/V conversion and the variation correction, and then outputs the display signal after the processing to the switching element SW4. The switching element SW4 turns on or off a connection therein according to a light emission control signal. When the switching element SW4 is on, the display signal from the circuit group 61 is supplied to the EL element 62. The EL element 62 thereby emits light.

Incidentally, each of the readout control signal, the reset signal, and the light emission control signal described with reference to FIG. 5 and FIG. 6 is supplied from the gate driver 23 or the source driver 24 via a control line not shown in the figures.

The display circuits 41 in related art and the light receiving circuits 42 in related art have been described above with reference to FIGS. 4 to 6. Display circuits in the display panel 25 in FIG. 1 are arranged one in each sub-pixel SubPix, as with the display circuit 41 in FIG. 4.

On the other hand, light receiving circuits in the display panel 25 in FIG. 1 are configured to output a received light signal with a higher S/N ratio than that of the light receiving circuits 42 in related art.

In order to further improve the S/N ratio of the received light signal, it suffices to simply increase the size (light receiving area) of the sensor SSR provided in each sub-pixel SubPix. However, an increase in the size of the sensor within the sub-pixel SubPix adversely affects display performance because of a reduction of an aperture and the like, and is thus better not effected.

When instead of providing the display circuit and the light receiving circuit on the same substrate, a display substrate and a light receiving substrate are produced separately, and a laminated structure of the display substrate and the light receiving substrate is formed, physical limitation on increasing the size of the sensor SSR is eliminated, but there occurs a problem of an increase in cost.

Figure 7:
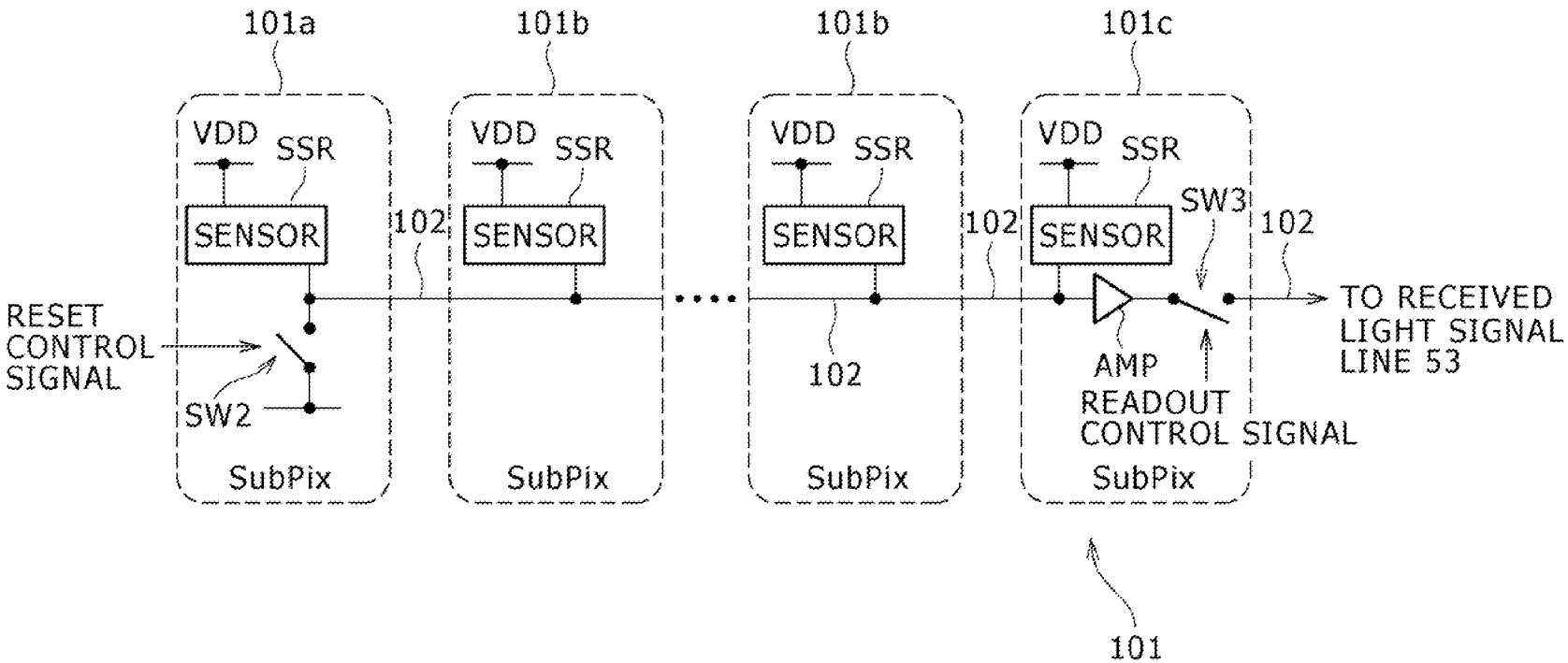
FIG. 7 is a diagram showing a configuration of a light receiving circuit used in a display panel in FIG. 1.

Therefore, in the display panel 25, as shown in FIG. 7, sensors SSR disposed in respective sub-pixels SubPix are connected in parallel with each other on a substrate. Thereby, sensor size is effectively increased, and thus the S/N ratio is improved.

That is, FIG. 7 shows a configuration of a light receiving circuit 101 employed in the display panel 25 of the information processing device 1.

The light receiving circuit 101 in FIG. 7 includes three kinds of subordinate light receiving circuits 101*a* to 101*c* and a sensor connecting line 102 for connecting outputs of the sensors SSR of the subordinate light receiving circuits 101*a* to 101*c* to each other. The subordinate light receiving circuit 101*a* is formed by a sensor SSR and a switching element SW2. The subordinate light receiving circuit 101*b* is formed by a sensor SSR. The subordinate light receiving circuit 101*c* is formed by a sensor SSR, an amplifier AMP, and a switching element SW3.

Incidentally, an arbitrary number of subordinate light receiving circuits 101*b* can be inserted between the subordinate light receiving circuit 101*a* and the subordinate light receiving circuit 101*c*. It is also possible to omit the subordinate light receiving circuit 101*b*.

While the amplifier AMP and the switching element SW3 need to be provided in the subordinate light receiving circuit 101*c*, which is connected to the received light signal line 53, the switching element SW2 may be disposed in any of the subordinate light receiving circuits 101*a* to 101*c* as long as the switching element SW2 is connected to the outputs of the sensors SSR.

Incidentally, the sensor sizes of the respective sensors SSR provided in the subordinate light receiving circuits 101*a* to 101*c* do not need to be the same. In the present embodiment, however, for simplicity of description, suppose that the sensor sizes of the respective sensors SSR provided in the subordinate light receiving circuits 101*a* to 101*c* are the same, and are the same as the size of the sensor SSR in the light receiving circuit 42.

In the light receiving circuit 101, received light signals supplied from the respective sensors SSR of the subordinate light receiving circuits 101*a* and 101*b* are input to the amplifier AMP in the subordinate light receiving circuit 101*c* via the sensor connecting line 102. A received light signal output by the sensor SSR of the subordinate light receiving circuit 101*c* is also input to the amplifier AMP in the subordinate light receiving circuit 101*c*. Hence, a signal input to the amplifier AMP is a sum total signal of the received light signals output from the sensors SSR of the subordinate light receiving circuits 101*a* to 101*c*. The amplifier AMP converts the received light signal (current signal) input to the amplifier AMP itself into a voltage signal, amplifies the voltage signal, and then outputs the amplified voltage signal.

Thus, the subordinate light receiving circuit 101*c* outputs the received light signals output from all of the sensors SSR of the subordinate light receiving circuits 101*a* to 101*c* forming the light receiving circuit 101 as the received light signal of the light receiving circuit 101. The received light signal output from the subordinate light receiving circuit 101*c* is supplied to the received light signal processing unit 26 via the received light signal line 53.

Figure 8:
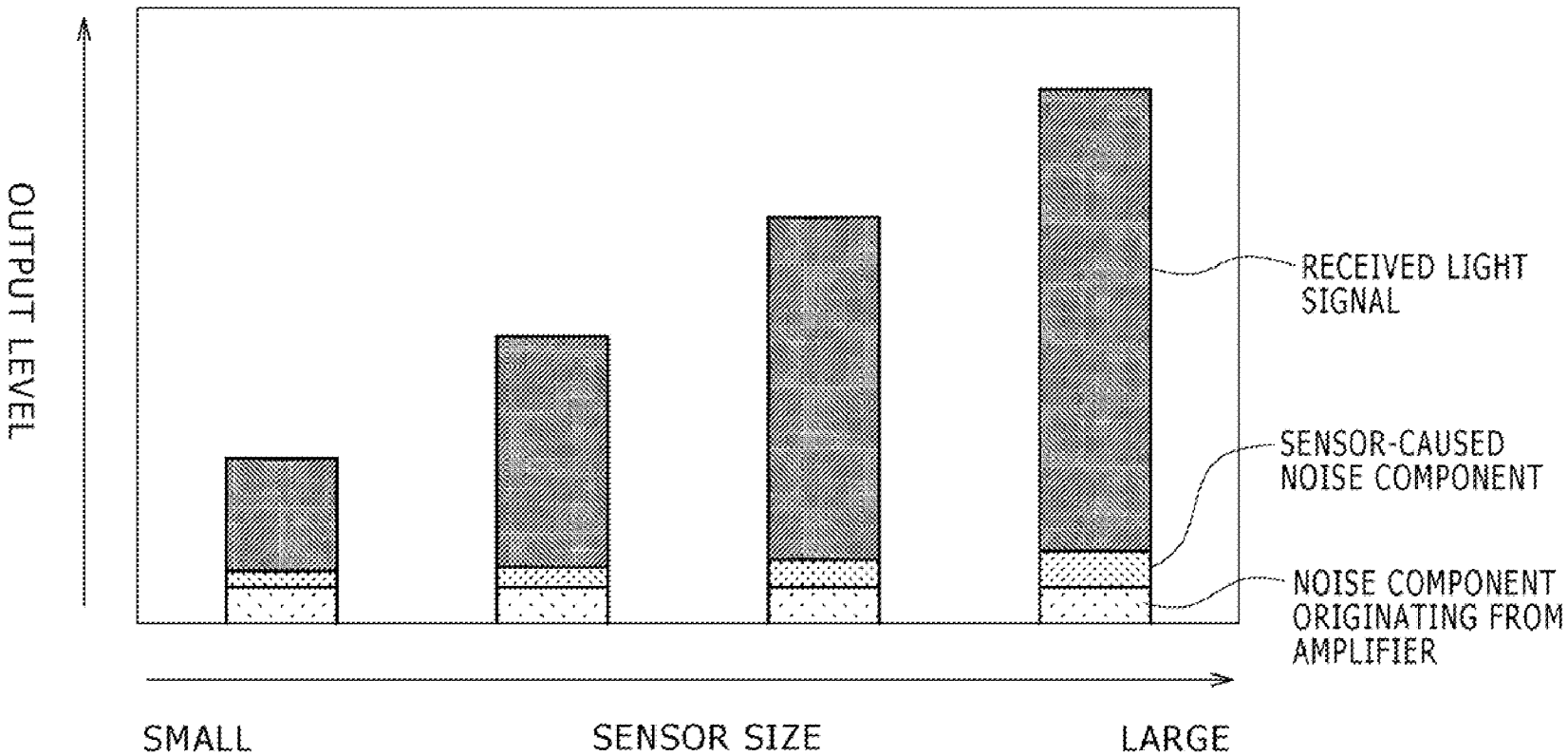
FIG. 8 is a diagram showing relation between sensor size and the level of an output signal.

FIG. 8 is a diagram showing relation between sensor size and the level of an output signal when the light receiving circuit 101 is formed as shown in FIG. 7.

An axis of abscissas in FIG. 8 indicates the sensor size of the sensors SSR of the light receiving circuit 101. The larger the number of subordinate light receiving circuits 101*a* to 101*c* forming the light receiving circuit 101, the larger the sensor size. An axis of ordinates in FIG. 8 indicates the level of the output signal (hereinafter referred to as output level) output by the light receiving circuit 101.

The output signal output by the light receiving circuit 101 includes a received light signal as a signal component and a sensor-caused noise signal and a noise signal originating from the amplifier AMP as a noise component. When the circuit configuration and the circuit constant of the amplifier AMP are not varied, the noise component originating from the amplifier AMP is unchanged. The circuit constant of the amplifier AMP is set so as to suit a circuit (system) connected in a stage succeeding the amplifier AMP. In the display panel 25, even when the number of subordinate light receiving circuits 101*a* to 101*c* forming the light receiving circuit 101 is changed, the circuit of the amplifier AMP and the subsequent circuit are not changed, and thus the circuit constant is also unchanged. Hence, the noise component originating from the amplifier AMP is unchanged even when the sensor size is increased.

On the other hand, the noise component originating from the sensors SSR, such for example as a leakage component, and the received light signal output by the sensors SSR are both increased in level in proportion to the sensor size. However, a rate of increase of the noise component originating from the sensors SSR is insignificant as compared with a rate of increase of the received light signal, as shown in FIG. 8.

Thus, by connecting the sensors SSR in parallel with each other and thereby effectively increasing the sensor size, it is possible to increase the S/N ratio of the received light signal.

When a plurality of sensors SSR arranged in respective sub-pixels SubPix are connected in parallel with each other on a substrate, two connecting methods are considered; that is, a method of connecting sensors SSR within respective sub-pixels SubPix arranged in the direction of the display signal line 51, or the vertical direction of the display panel 25, to each other, and a method of connecting sensors SSR within respective sub-pixels SubPix arranged in the direction of the display selection line 52, or the horizontal direction of the display panel 25, to each other. Because the display panel 25 in which pixels Pix are in the delta arrangement has a wiring pattern referred to as a horizontal stripe canceller on the substrate, it is difficult to carry out the former connecting method, that is, connect sensors SSR arranged in the vertical direction to each other.

Reasons that the presence of the horizontal stripe canceller makes it difficult to connect sensors SSR arranged in the vertical direction to each other will be described in detail with reference to FIGS. 9 to 11.

The horizontal stripe canceller is a wiring pattern formed to prevent a variation in luminance (horizontal stripe) occurring in each horizontal line. In the delta arrangement, colors assigned to display signal lines 51 disposed on both sides of a sub-pixel SubPix in an odd-numbered horizontal line (hereinafter referred to as an odd-numbered line) are different from colors assigned to display signal lines 51 disposed on both sides of a sub-pixel SubPix in an even-numbered horizontal line (hereinafter referred to as an even-numbered line). Therefore a kind of noise entering the sub-pixel SubPix in the odd-numbered line is different from a kind of noise entering the sub-pixel SubPix in the even-numbered line. As a result, a variation in luminance (horizontal stripe) occurs in each horizontal line.

Figure 9:
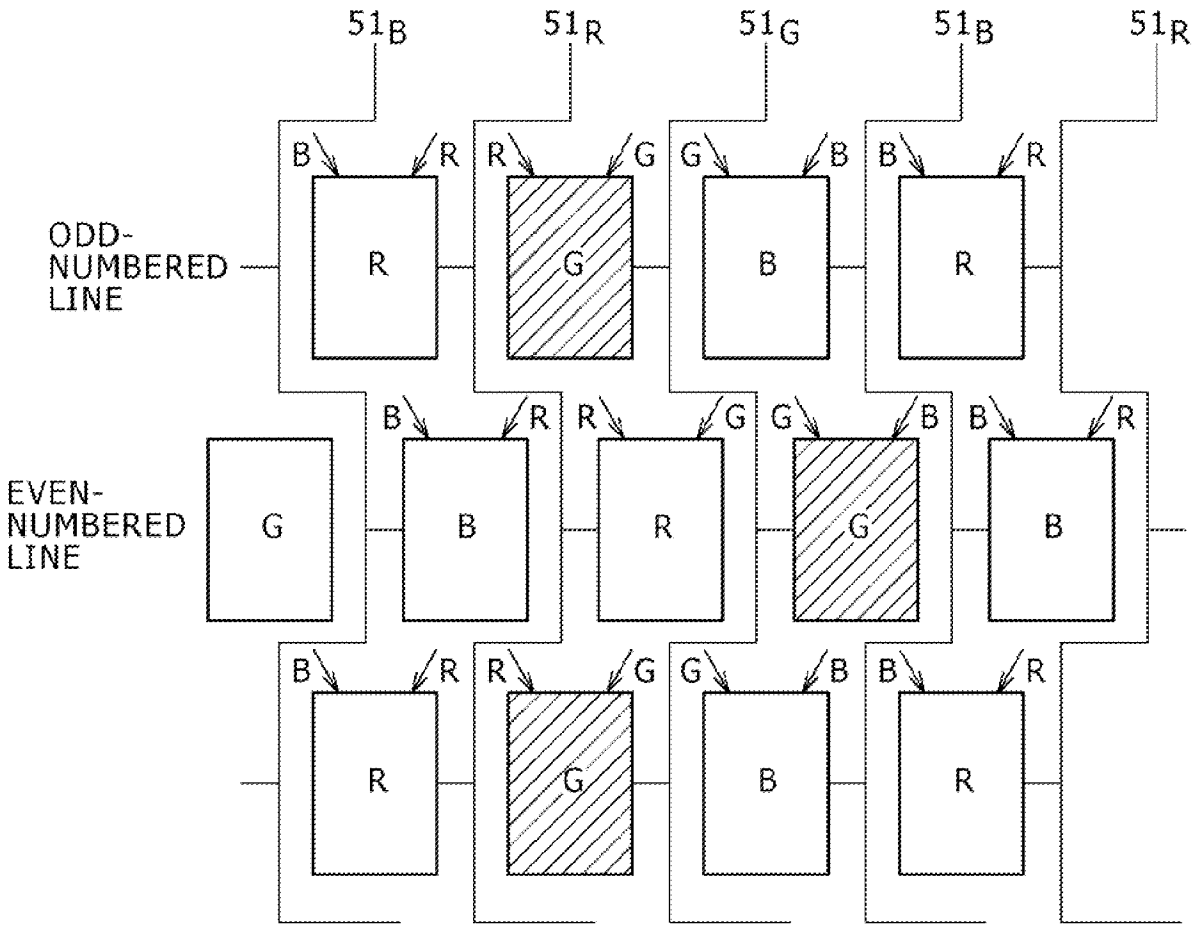
FIG. 9 is a diagram of assistance in explaining a horizontal stripe canceller.

More specifically, directing attention to sub-pixels SubPix of G in the delta arrangement shown in FIG. 9, a display signal line 51R connected to sub-pixels SubPix of R and a display signal line 51G connected to sub-pixels SubPix of G are disposed on both sides of a sub-pixel SubPix of G in an odd-numbered line. On the other hand, the display signal line 51G connected to the sub-pixels SubPix of G and a display signal line 51B connected to sub-pixels SubPix of B are disposed on both sides of a sub-pixel SubPix of G in an even-numbered line.

Hence, noises affected by the display signals of R and G passing on both sides of the sub-pixel SubPix of G in the odd-numbered line occur in the sub-pixel SubPix of G in the odd-numbered line, while noises affected by the display signals of G and B passing on both sides of the sub-pixel SubPix of G in the even-numbered line occur in the sub-pixel SubPix of G in the even-numbered line. Thus, a kind of noise entering the sub-pixel SubPix in the odd-numbered line is different from a kind of noise entering the sub-pixel SubPix in the even-numbered line. Therefore horizontal stripes occur. The horizontal stripe canceller is formed in each sub-pixel SubPix on the substrate to prevent the horizontal stripes.

Figure 10:
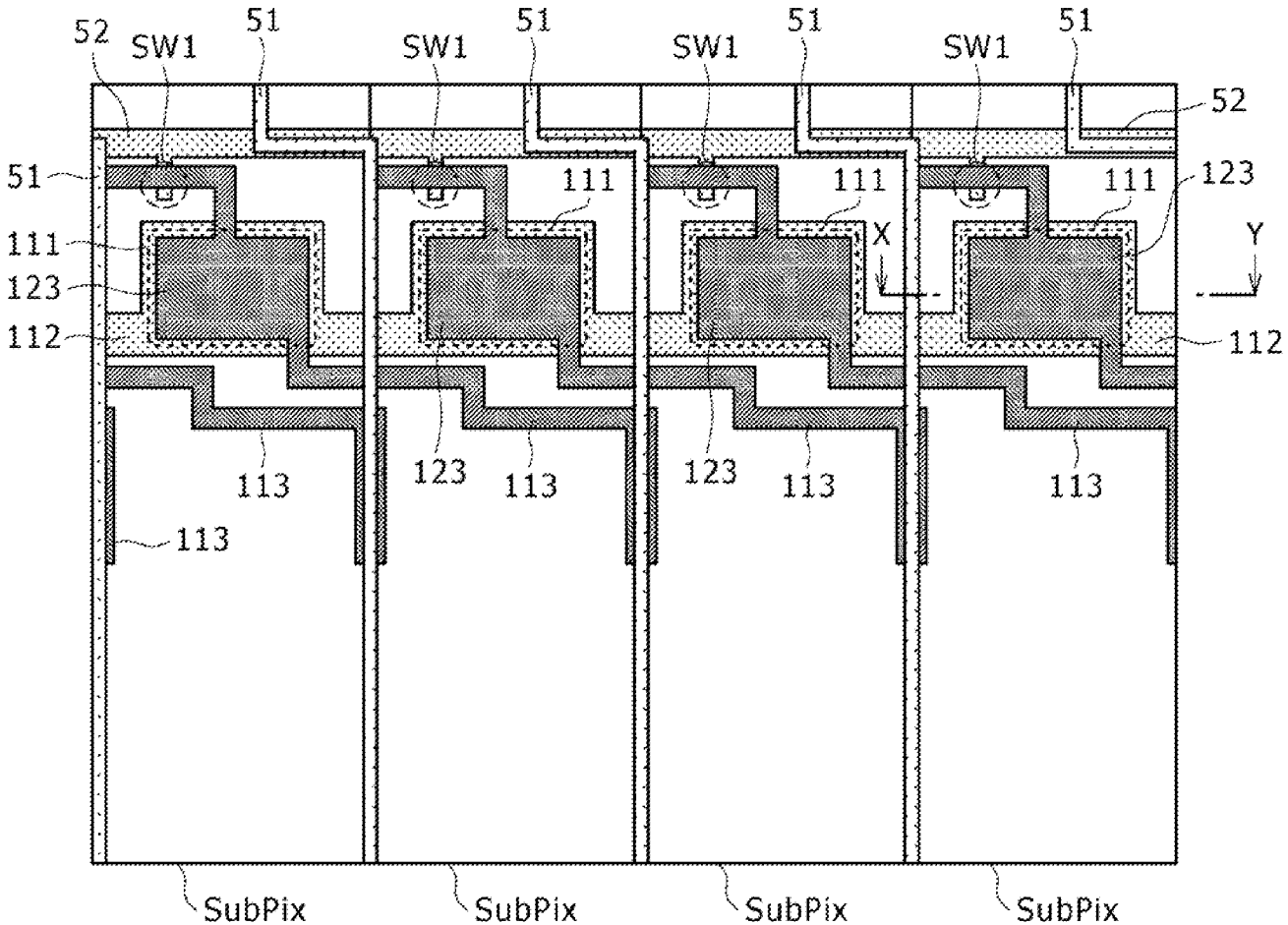
FIG. 10 is a diagram of assistance in explaining reasons that it is difficult to connect sensors SSR arranged in a vertical direction to each other.

FIG. 10 shows a wiring pattern of a display circuit 41 within each sub-pixel SubPix. FIG. 11 is a sectional view taken along a line X-Y of FIG. 10.

Figure 11:
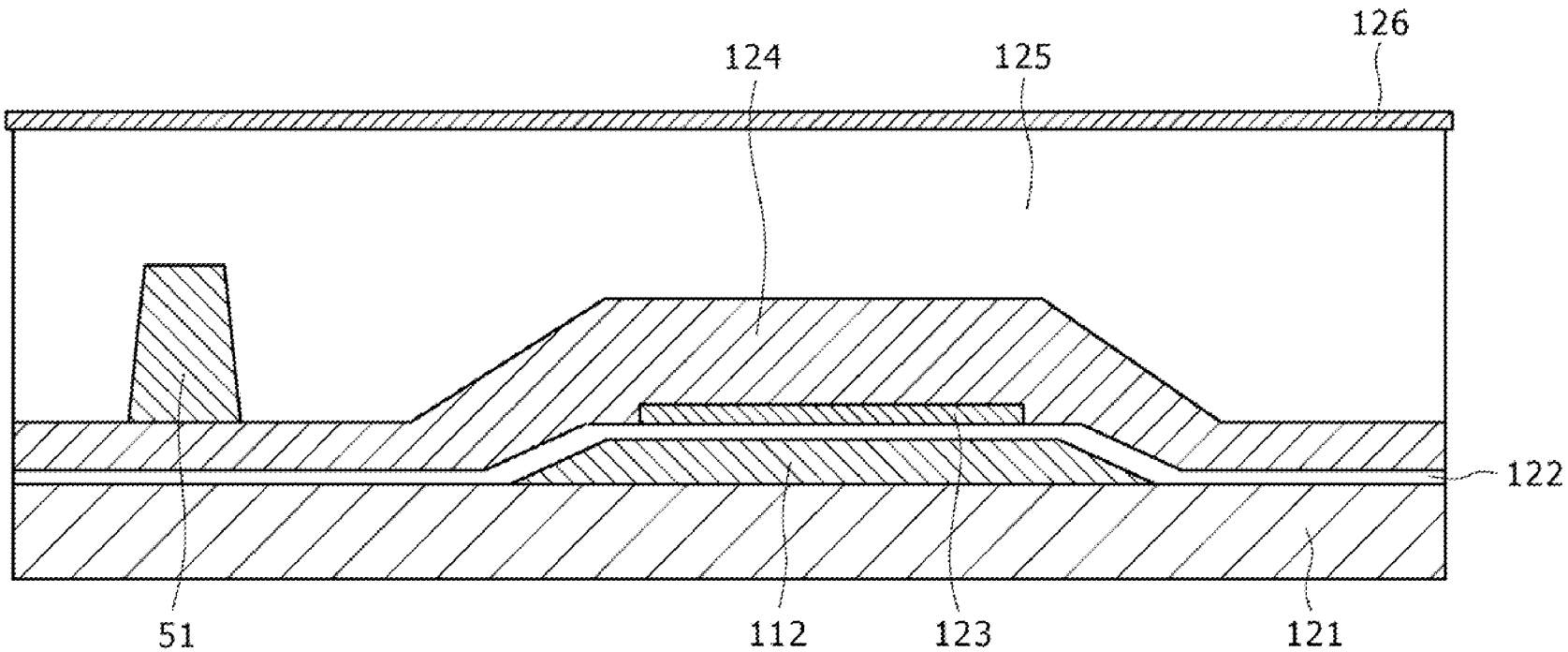
FIG. 11 is a diagram of assistance in explaining reasons that it is difficult to connect sensors SSR arranged in the vertical direction to each other.

As shown in FIG. 11, a storage capacitor line 112 is formed by a first conductive film in a lowermost layer of a plurality of thin film layers formed over a substrate 121, that is, on a side nearest to the substrate 121. This first conductive film is also used to form a display selection line 52 (FIG. 10).

A polycrystalline or amorphous silicon 123 as a second conductive film is formed on an insulating film 122 formed on the storage capacitor line 112. As shown in FIG. 10, the polycrystalline or amorphous silicon 123, together with the storage capacitor line 112 formed in a rectangular shape, constitutes a storage capacitor formation part 111. In addition, as shown in FIG. 10, the polycrystalline or amorphous silicon 123 forms a horizontal stripe canceller 113. Because the horizontal stripe canceller 113 is formed so as to traverse a neighboring sub-pixel SubPix, there is a fear of a decrease in the aperture ratio of the pixel. However, the polycrystalline or amorphous silicon 123 is a transparent conductor film, so that a decrease in the aperture ratio of the pixel can be prevented.

The polycrystalline or amorphous silicon 123 is covered with an insulating film 124 as shown in FIG. 11. A display signal line 51 is formed by a third conductive film on the insulating film 124. Further, a planarizing film 125 planarizes the film surfaces of the insulating film 124 and the display signal line 51. A transparent electrode 126 is formed on the planarizing film 125.

Thus, the three conductive film layers are present on the substrate 121 on which the display circuit 41 is formed; that is, the first conductive film forming the display selection line 52 and the storage capacitor line 112, the second conductive film forming the horizontal stripe canceller 113, and the third conductive film forming the display signal line 51 in increasing order of distance from the substrate 121.

Accordingly, whether a sensor connecting line 102 connecting sensors SSR of sub-pixels SubPix in the vertical direction to each other can be formed on the substrate 121 using the first to third conductive films will be considered in order. Incidentally, although the transparent electrode 126 (pixel electrode) is also a conductive film layer, the transparent electrode 126 is an electrode for applying an electric field for liquid crystal alignment, and therefore not for being used as a conductive film forming a circuit.

First, considering forming the sensor connecting line 102 using the first conductive film forming the display selection line 52 and the storage capacitor line 112, the display selection line 52 and the storage capacitor line 112 traverse sub-pixels SubPix, and when the sensor connecting line 102 is formed in the vertical direction using the first conductive film, the sensor connecting line 102 intersects both of the display selection line 52 and the storage capacitor line 112. Therefore it may be impossible to form the sensor connecting line 102 using the first conductive film.

Next, also in the case of forming the sensor connecting line 102 using the second conductive film forming the horizontal stripe canceller 113, the horizontal stripe canceller 113 traverses the sub-pixels SubPix, and therefore it may be impossible to form the sensor connecting line 102 in the vertical direction using the second conductive film for the same reason.

As for the last case of forming the sensor connecting line 102 using the third conductive film forming the display signal line 51, when the sensor connecting line 102 is formed by the third conductive film forming the display signal line 51, a noise caused by a signal charging the transparent electrode 126 from the display signal line 51 via the switching element SW1 occurs in a received light signal on the sensor connecting line 102. This invites a degradation in quality of the received light signal. Therefore it may be impossible to form the sensor connecting line 102 on the substrate 121 using the third conductive film.

Thus, with the layer structure of conductive film layers in a present situation, it is difficult to form the sensor connecting line 102 for connecting sensors SSR arranged in the vertical direction with each other on the substrate 121.

Therefore, in the display panel 25, sensors SSR arranged in the horizontal direction are connected to each other. That is, the sensors SSR of sub-pixels SubPix arranged in a direction perpendicular to the wiring direction of the display signal line 51 (horizontal direction) are connected to each other by the sensor connecting line 102.

FIG. 12 shows an example of arrangement of a light receiving circuit 101 in a case where the light receiving circuit 101 includes a subordinate light receiving circuit 101*a*, one subordinate light receiving circuit 101*b*, and a subordinate light receiving circuit 101*c*, and the subordinate light receiving circuit 101*a*, the one subordinate light receiving circuit 101*b*, and the subordinate light receiving circuit 101*c* are disposed in three sub-pixels SubPix, respectively.

In FIG. 12, display signal lines 51 for supplying a display signal to sub-pixels SubPix are wired in a same direction in all the sub-pixels SubPix. The subordinate light receiving circuit 101*a*, the subordinate light receiving circuit 101*b*, and the subordinate light receiving circuit 101*c* are respectively disposed in the three sub-pixels SubPix arranged in the direction perpendicular to the display signal lines 51, that is, in the horizontal direction, and are connected to each other by the sensor connecting line 102.

A VDD line and a GND line for supplying power to the subordinate light receiving circuits 101*a* to 101*c* and a received light signal line 53 for transmitting a received light signal output from the light receiving circuit 101 to the received light signal processing unit 26 are wired in the same direction as the display signal lines 51.

The VDD line and the GND line branch off at a right angle at the same position in the vertical direction as the subordinate light receiving circuits 101*a* to 101*c* to be connected to each of the subordinate light receiving circuits 101*a* to 101*c*. The received light signal line 53 is connected to the subordinate light receiving circuit 101*c* via the sensor connecting line 102. The subordinate light receiving circuits 101*a* to 101*c* are connected to each other by the sensor connecting line 102.

In FIG. 12, wiring patterns formed by a same conductive film are schematically represented by a same design. Thus, the received light signal line 53, the VDD line, and the GND line are formed on the substrate 121 by the third conductive film, which is the same as that of the display signal lines 51. However, at positions where the VDD line and the GND line arranged in the horizontal direction intersect the display signal lines 51 arranged in the vertical direction, the VDD line and the GND line are formed by the same first conductive film as the display selection line 52 and the storage capacitor line 112, as shown in FIG. 12. The sensor connecting line 102 connecting the subordinate light receiving circuits 101*a* to 101*c* to each other is formed by the same second conductive film as the horizontal stripe canceller 113.

Thus, to connect the subordinate light receiving circuits 101*a* to 101*c* to each other does not need the addition of a new conductive film layer. In addition, because the sensor connecting line 102 is formed on the substrate by the conductive film different from that of the display signal lines 51, noise caused by a display signal does not occur in the sensor connecting line 102.

Figure 13:
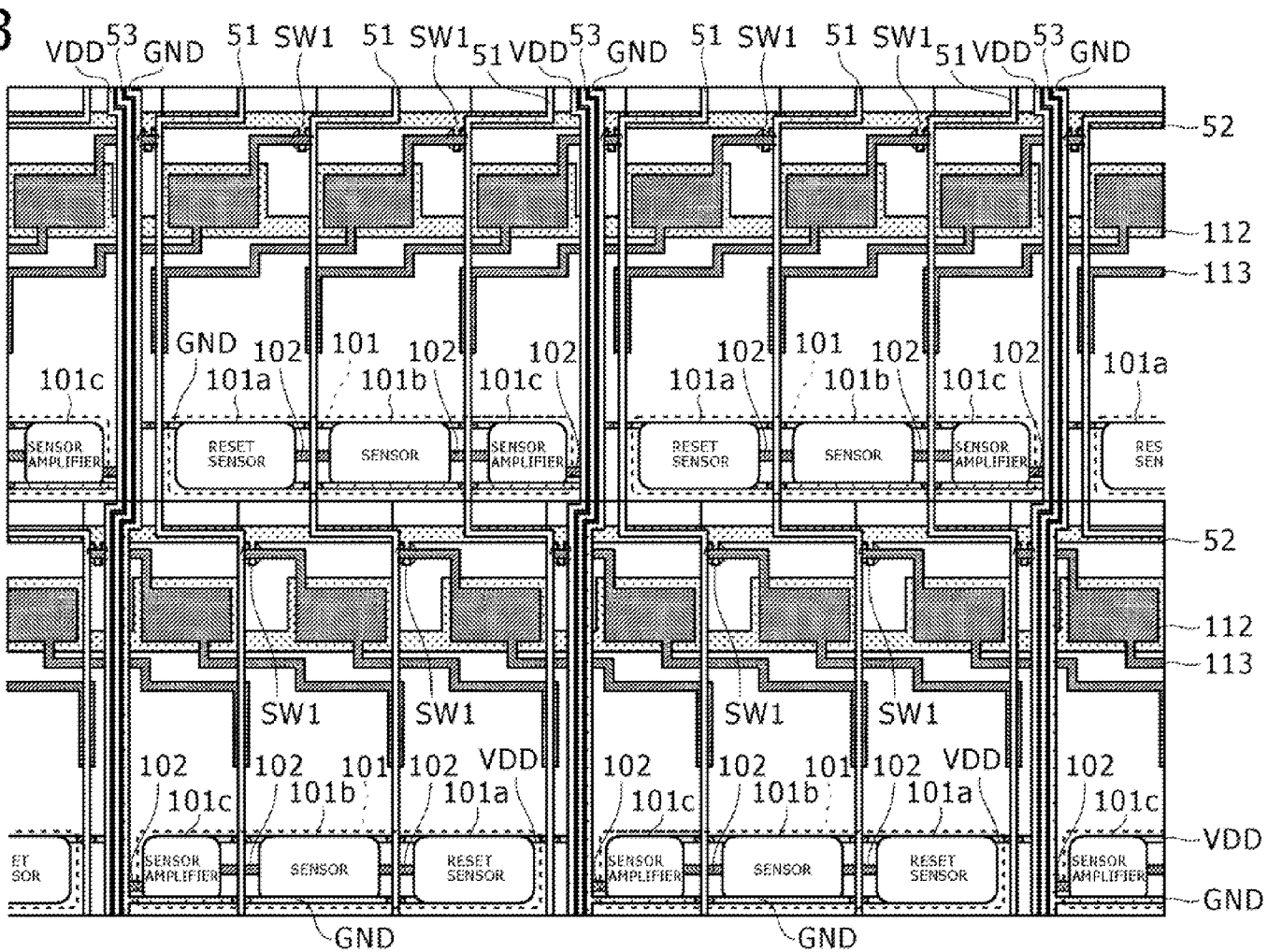
FIG. 13 is a diagram showing a display panel in which sub-pixels shown in FIG. 12 are arranged in the form of a matrix.

FIG. 13 is a diagram showing an arrangement of light receiving circuits 101 of FIG. 12 in two lines, that is, an odd-numbered line and an even-numbered line.

A side from which the output of a sensor SSR is extracted within each sub-pixel SubPix is the same as a side where a display signal line 51 for the sub-pixel SubPix is disposed. That is, in the odd-numbered line, a display signal line 51 for transmitting a display signal for a sub-pixel SubPix is disposed on the right side of the sub-pixel SubPix in FIG. 13, and the sensor connecting line 102 is also disposed on the right side of the subordinate light receiving circuits 101*a* to 101*c* in FIG. 13. On the other hand, in the even-numbered line, a display signal line 51 for transmitting a display signal for a sub-pixel SubPix is disposed on the left side of the sub-pixel SubPix in FIG. 13, and the sensor connecting line 102 is also disposed on the left side of the subordinate light receiving circuits 101*a* to 101*c* in FIG. 13. In other words, the side from which the output of a sensor SSR is extracted within each sub-pixel SubPix is a side where a switching element SW1 is disposed, which side is either the left side or the right side of the sub-pixel SubPix in FIG. 13. Thus, the arrangement of the subordinate light receiving circuit 101*a* and the subordinate light receiving circuit 101*c* in the odd-numbered line in FIG. 13 is opposite to the arrangement of the subordinate light receiving circuit 101*a* and the subordinate light receiving circuit 101*c* in the even-numbered line in FIG. 13.

Figure 14:
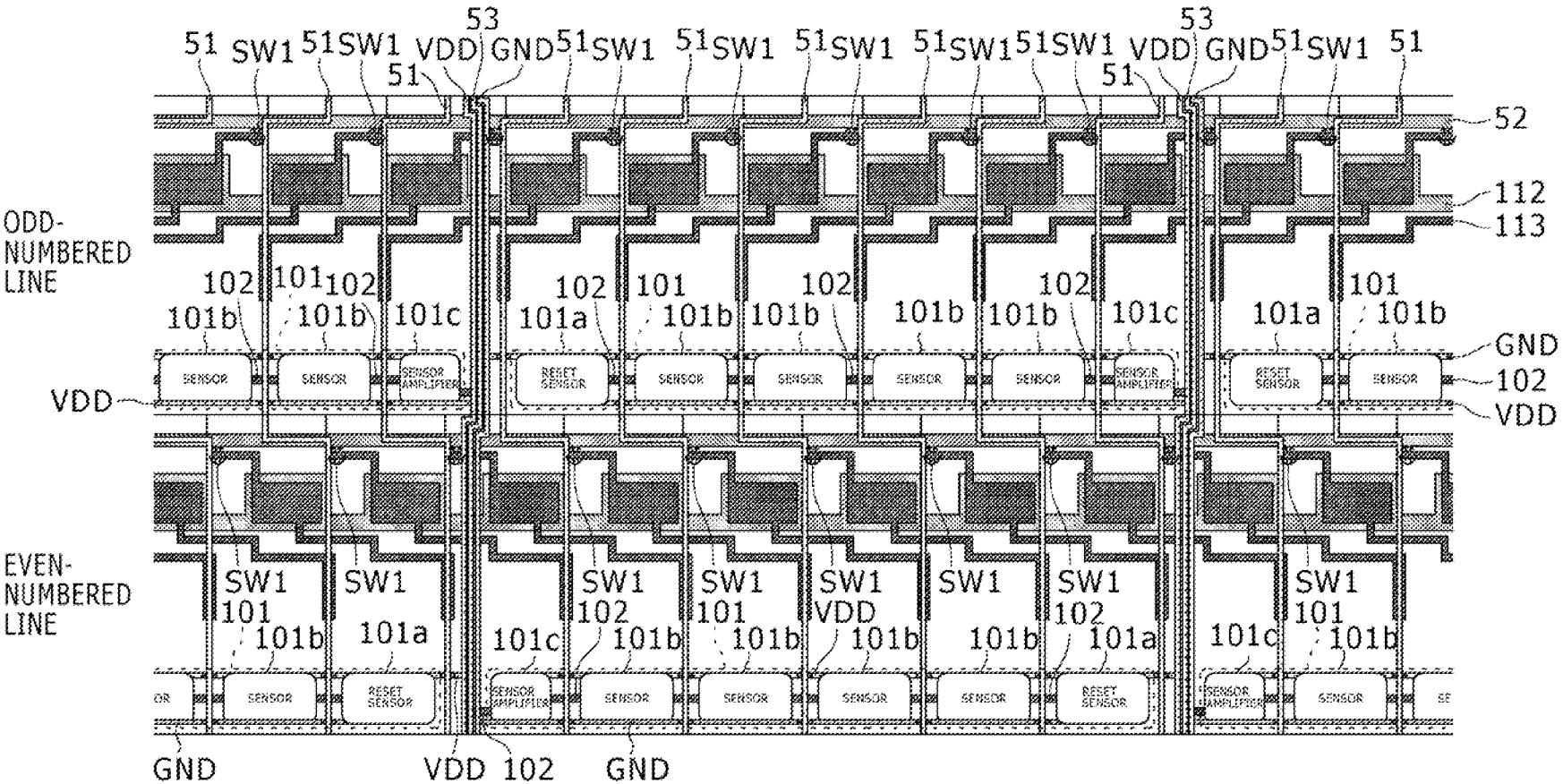
FIG. 14 is a diagram showing another example of arrangement of light receiving circuits in the display panel in FIG. 1.

FIG. 14 shows another example of arrangement of a light receiving circuit 101. That is, FIG. 14 shows an example of arrangement of a light receiving circuit 101 in a case where the light receiving circuit 101 includes a subordinate light receiving circuit 101*a*, four subordinate light receiving circuits 101*b*, and a subordinate light receiving circuit 101*c*, and the subordinate light receiving circuit 101*a*, the four subordinate light receiving circuits 101*b*, and the subordinate light receiving circuit 101*c* are disposed in six sub-pixels SubPix, respectively.

The arrangement in FIG. 14 is the same as in FIG. 13 except for a different number of subordinate light receiving circuits 101*b* (which number is also the number of sub-pixels SubPix) inserted between the subordinate light receiving circuit 101*a* and the subordinate light receiving circuit 101*c*.

Thus, by only changing the number of subordinate light receiving circuits 101*b* inserted between the subordinate light receiving circuit 101*a* and the subordinate light receiving circuit 10*c*, it is possible to easily increase effective sensor size and thus improve the S/N ratio of a received light signal.

Figure 15:
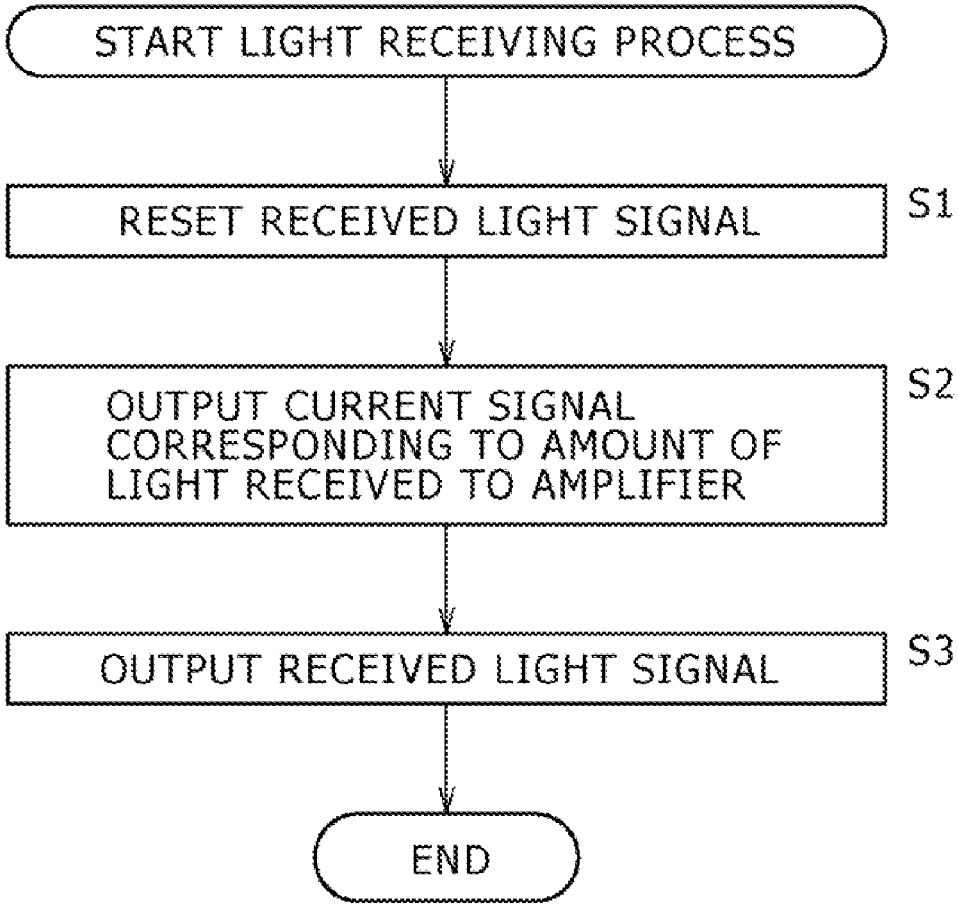
FIG. 15 is a flowchart of assistance in explaining a light receiving process by the light receiving circuit of FIG. 7.

A light receiving process by the light receiving circuit 101 will be described with reference to a flowchart of FIG. 15.

When a reset control signal for turning off the connection of the switching element SW2 of the light receiving circuit 101 is supplied to the switching element SW2 of the light receiving circuit 101, in step S1, the switching element SW2 turns off the connection thereof to reset a received light signal.

In step S2, the respective sensors SSR of the subordinate light receiving circuits 101*a* to 101*c* forming the light receiving circuit 101 output a current signal corresponding to an amount of light received to the amplifier AMP.

When a readout control signal for turning on the connection of the switching element SW3 of the light receiving circuit 101 is supplied to the switching element SW3 of the light receiving circuit 101, in step S3, the light receiving circuit 101 outputs a received light signal. That is, the amplifier AMP in the subordinate light receiving circuit 101*c* converts the current signal input to the amplifier AMP into a voltage signal, and outputs a result of amplifying the voltage signal as the received light signal.

As described above, in the display panel 25 in which pixels are arranged in the delta arrangement, sensors SSR respectively disposed in a plurality of sub-pixels SubPix arranged in a direction perpendicular to the wiring direction of the display signal lines 51 (horizontal direction) are connected in parallel with each other on the substrate. It is thereby possible to effectively increase the sensor size, and thus improve the S/N ratio of the received light signal. That is, the S/N ratio of the received light signal can be increased with a simple configuration.

It is to be noted that embodiments are not limited to the above-described embodiments, and that various changes can be made without departing from the spirit of the present application.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device comprising:

a plurality of sub-pixels forming a pixel as a unit of display resolution of an image, said plurality of sub-pixels being arranged in a delta arrangement;

a display circuit for displaying said image;

a light receiving sensor for detecting light, said display circuit and said light receiving sensor being disposed in each of said sub-pixels, wherein display signal lines for supplying a display signal to said sub-pixels are wired to all of said sub-pixels in a same direction, two or more said light receiving sensors arranged in a direction perpendicular to the wiring direction of said display signal lines are connected to each other, and a received light signal obtained from the two or more said light receiving sensors connected to each other is output from a light receiving circuit, wherein the light receiving circuit includes at least two types of subordinate light receiving circuits disposed in different sub-pixels of a same pixel, wherein only one type of subordinate light receiving circuit includes an amplifier.

2. The display device as claimed in claim 1, wherein a received light signal line to which said received light signal is output is wired in a same direction as the wiring direction of said display signal lines.

3. The display device as claimed in claim 1, wherein said display circuit controls transmittance for light from a backlight by a liquid crystal layer.

4. The display device as claimed in claim 1, wherein said light receiving sensor is one of a TFT as Thin Film Transistor and a diode.

5. The display device as claimed in claim 1, wherein said display circuit controls a self-luminous element.

6. The display device as claimed in claim 1, wherein said sub-pixels include sub-pixels of R as Red, G as Green, and B as Blue.

7. A light receiving method of a display device, said display device having a plurality of sub-pixels forming a pixel as a unit of display resolution of an image, said plurality of sub-pixels being arranged in a delta arrangement, a display circuit for displaying said image and a light receiving sensor for detecting light, said display circuit and said light receiving sensor being disposed in each of said sub-pixels, display signal lines for supplying a display signal to said sub-pixels, said display signal lines being wired to all of said sub-pixels in a same direction, and a light receiving circuit including at least two types of subordinate light receiving circuits disposed in different sub-pixels of a same pixel, wherein only one type of subordinate light receiving circuit includes an amplifier, said light receiving method comprising:

outputting a received light signal obtained from two or more of said light receiving sensors arranged in a direction perpendicular to the wiring direction of said display signal lines.

8. The light receiving method as claimed in claim 7, wherein a received light signal line to which said received light signal is output is wired in a same direction as the wiring direction of said display signal lines.

9. The light receiving method as claimed in claim 7, wherein said display circuit controls transmittance for light from a backlight by a liquid crystal layer.

10. The light receiving method as claimed in claim 7, wherein said light receiving sensor is one of a TFT as Thin Film Transistor and a diode.

11. The light receiving method as claimed in claim 7, wherein said display circuit controls a self-luminous element.

12. The light receiving method as claimed in claim 7, wherein said sub-pixels include sub-pixels of R as Red, G as Green, and B as Blue.

13. An information processing device comprising:

displaying and light receiving means for displaying predetermined information as an image and detecting light by a light receiving sensor;

input information analyzing means for analyzing externally input information, using a received light image generated from a received light signal output by said light receiving sensor; and controlling means for performing a predetermined controlling process in correspondence with a message supplied from said input information analyzing means;

wherein in said displaying and light receiving means, a plurality of sub-pixels forming a pixel as a unit of display resolution of said image are arranged in a delta arrangement, a display circuit for displaying said image and said light receiving sensor are disposed in each of said sub-pixels, a display signal line for supplying a display signal to said sub-pixels is wired to all of said sub-pixels in a same direction, and a light receiving circuit including at least two types of subordinate light receiving circuits disposed in different sub-pixels of a same pixel, wherein only one type of subordinate light receiving circuit includes an amplifier, and said displaying and light receiving means outputs a received light signal obtained from two or more said light receiving sensors arranged in a direction perpendicular to the wiring direction of said display signal lines.

14. The information processing device as claimed in claim 13, wherein a received light signal line to which said received light signal is output is wired in a same direction as the wiring direction of said display signal lines.

15. The information processing device as claimed in claim 13, wherein said display circuit controls transmittance for light from a backlight by a liquid crystal layer.

16. The information processing device as claimed in claim 13, wherein said light receiving sensor is one of a TFT as Thin Film Transistor and a diode.

17. The information processing device as claimed in claim 13, wherein said display circuit controls a self-luminous element.

18. The information processing device as claimed in claim 13, wherein said sub-pixels include sub-pixels of R as Red, G as Green, and B as Blue.

19. An information processing device comprising:

a displaying and light receiving section configured to display predetermined information as an image and detecting light by a light receiving sensor;

an input information analyzing section configured to analyze externally input information, using a received light image generated from a received light signal output by said light receiving sensor; and a controlling section configured to perform a predetermined controlling process in correspondence with a message supplied from said input information analyzing section;

wherein in said displaying and light receiving section, a plurality of sub-pixels forming a pixel as a unit of display resolution of said image are arranged in a delta arrangement, a display circuit for displaying said image and said light receiving sensor are disposed in each of said sub-pixels, a display signal line for supplying a display signal to said sub-pixels is wired to all of said sub-pixels in a same direction, and a light receiving circuit including at least two types of subordinate light receiving circuits disposed in different sub-pixels of a same pixel, wherein only one type of subordinate light receiving circuit includes an amplifier, and said displaying and light receiving section outputs a received light signal obtained from two or more said light receiving sensors arranged in a direction perpendicular to the wiring direction of said display signal lines.

20. The display device as claimed in claim 1, further comprising:

a first type of subordinate light receiving circuit including a first sensor and a first switching element, and lacking an amplifier, and a second type of subordinate light receiving circuit including a second sensor, a second switching element, and an amplifier, wherein a subordinate light receiving circuit of the first type is disposed in a first sub-pixel and a subordinate light receiving circuit of the second type is disposed in a second sub-pixel in a same pixel as the first sub-pixel.

21. The display device as claimed in claim 1, wherein only one subordinate light receiving circuit in the pixel includes an amplifier, and a sum total signal output from the two or more said light receiving sensors is input to the amplifier.

* * * * *

UNITED STATES PATENT AND TRADEMARK OFFICE

CERTIFICATE OF CORRECTION

PATENT NO. : 8,004,484 B2
APPLICATION NO. : 11/857280
DATED : August 23, 2011
INVENTOR(S) : Tateuchi et al.

It is certified that error appears in the above-identified patent and that said Letters Patent is hereby corrected as shown below:

On the Title Page of the patent, add:

Foreign Application Priority Data
October 10, 2006 (JP).....P2006-276041.

In the Specification

At column 1, line 9, please replace:

"JP 2006-27604" with --JP 2006-276041--.

Signed and Sealed this
Fifth Day of November, 2013

Teresa Stanek Rea

Teresa Stanek Rea
*Deputy Director of the United States Patent and Trademark Office*